US008622012B2

(12) United States Patent
Olofsson

(10) Patent No.: US 8,622,012 B2
(45) Date of Patent: Jan. 7, 2014

(54) ARRANGEMENT FOR DYNAMIC CONTROL OF RUNNING TRIM AND LIST OF A BOAT

(75) Inventor: Niclas Olofsson, Varberg (SE)

(73) Assignee: Humphree AB, Goteborg (SE)

( * ) Notice: Subject to any disclaimer, the term of this patent is extended or adjusted under 35 U.S.C. 154(b) by 86 days.

(21) Appl. No.: 12/921,170

(22) PCT Filed: Mar. 12, 2008

(86) PCT No.: PCT/SE2008/050273

§ 371 (c)(1),
(2), (4) Date: Sep. 7, 2010

(87) PCT Pub. No.: WO2009/113923

PCT Pub. Date: Sep. 17, 2009

(65) Prior Publication Data

US 2011/0017115 A1 Jan. 27, 2011

(51) Int. Cl.
*B63B 39/06* (2006.01)
*B63B 1/16* (2006.01)

(52) U.S. Cl.
USPC ..... 114/284; 114/285; 114/122; 114/126

(58) Field of Classification Search
USPC ..... 114/121, 122, 126, 145 R, 145 A, 152, 114/170, 271, 274–290
See application file for complete search history.

(56) References Cited

U.S. PATENT DOCUMENTS 591,134 A * 10/1897 Howard ..... 312/331
1,264,320 A * 4/1918 Metzler ..... 114/145 R (Continued)

FOREIGN PATENT DOCUMENTS

EP 1075415 B1 12/2003
EP 1477402 A1 11/2004

(Continued)

OTHER PUBLICATIONS

International Search Report and Written Opinion mailed Dec. 11, 2008 in parent PCT application.

(Continued)

*Primary Examiner* — Ajay Vasudeva
(74) *Attorney, Agent, or Firm* — Jeffrey S. Melcher; Manelli Selter PLLC

(57) ABSTRACT

The invention relates to an arrangement (1) for dynamic control of running trim and list of a boat, said boat having at least one hull (2) with a stern (3), said arrangement (1) having a housing member (9), an interceptor member (5), an actuating means (10), a drive unit (7) operated by a power supply means (8), and a guiding means (22), said guiding means (22) being arranged to guide said interceptor member (5) between a first end position and a second end position, said actuating means (10) being arranged to displace said interceptor member (5) in a movement between said first and second end positions in relation to said housing member (9) by being driven by said drive unit (7), and said housing member (9) fully enclosing said interceptor member (5) in said first end position and partially enclosing said interceptor member (5) in said second end position. According to the invention, said guiding means (22) has a first guiding member (23) and a second guiding member (24) which are arranged to interact with each other, said first guiding member (23) being a rotatable element arranged to extend transverse to the direction of displacement of said interceptor member (5), and said second guiding member (24) being a guiding surface against which said first guiding member runs (23).

4 Claims, 6 Drawing Sheets

(56) References Cited

U.S. PATENT DOCUMENTS

| | | | | | |
|---|---|---|---|---|---|
| 1,475,460 | A | * | 11/1923 | Schein et al. | 114/122 |
| 1,799,455 | A | * | 4/1931 | Cavert | 114/145 R |
| 2,075,594 | A | * | 3/1937 | Throndsen | 114/126 |
| 2,258,948 | A | * | 10/1941 | Garrison | 312/110 |
| 3,323,853 | A | * | 6/1967 | Stark | 312/331 |
| 3,327,671 | A | * | 6/1967 | Comins | 114/285 |
| 3,690,284 | A | * | 9/1972 | Van de Stadt | 114/152 |
| 6,006,689 | A | * | 12/1999 | Olofsson | 114/285 |
| 2007/0101920 | A1 | | 5/2007 | Loui | |

FOREIGN PATENT DOCUMENTS

| | | | |
|---|---|---|---|
| FR | 2328366 | A7 | 5/1977 |
| GB | 106647 | A | 5/1917 |
| WO | 96/20105 | A1 | 7/1996 |
| WO | 9620105 | A1 | 7/1996 |
| WO | 2005118384 | A1 | 12/2005 |
| WO | 2006058232 | A1 | 6/2006 |

OTHER PUBLICATIONS

European Search Report issued on Jan. 30, 2013 in corresponding European Patent Application Ser. No. 08724220.2, based on PCT/SE2008/050273.
Roman Crank Handle, Wikipedia, (250 AD).
Hierapolis sawmill, Wikipedia (300).
Taccola, Wikipedia (1453).
Rope pump, Wikipedia (1980).
Chain pump, Wikipedia (700 BC).
Al-Jazari Automata, Wikipedia (1205).
Su Song, Clocktower, Wikipedia (1101).
Bicycle Plymouth, Wikipedia (1923).

* cited by examiner

ARRANGEMENT FOR DYNAMIC CONTROL OF RUNNING TRIM AND LIST OF A BOAT

TECHNICAL FIELD

The present invention relates to an arrangement for dynamic control of running trim and list of a boat according to the preamble of claim 1.

BACKGROUND ART

A number of different devices and arrangements intended for dynamic control of running trim of vessels or boats are previously known.

One such previously known arrangement comprises the use of a so-called interceptor member, constituted of a plate or an interceptor member preferably arranged transverse to the bottom of the vessel and arranged thereto. During driving of the vessel, such an interceptor member increases the water pressure acting on the bottom of the hull in front of the interceptor member and, accordingly, changes the running trim of the boat or vessel.

EP 1 075 415 discloses an arrangement for dynamic control of running trim and list of a boat, which boat has a hull with a stern. The disclosed arrangement comprises a T-shaped interceptor member and a T-shaped housing member, actuating means provided in the vicinity of a substantially vertical part of the interceptor member and the housing member, respectively, and a power supply means. The actuating means is arranged for displacing the interceptor member in a generally continuous and linear movement, in a generally vertical direction, between first and second end positions in relation to the housing member. The interceptor member has a first and a second portion, wherein the first portion extends essentially perpendicular from the middle of the entire length of the second portion. The housing member partially encloses the first portion so that the housing member guides the first portion during the linear movement of the interceptor.

According to EP 1 075 415, the actuating means is arranged in the middle of the external edges of the elongated housing member and the interceptor member, i.e. the actuating means is arranged to act symmetrically in the direction of displacement of the interceptor member. This is to avoid jamming of the interceptor member during movement of the interceptor member between the first and second positions.

In the case when a water jet units are used to operate a boat or vessel, the discharge openings, i.e. the outlet nozzles, of such water jet units are normally positioned far down on the stern, for example in the vicinity of the lower edge of the stern. This means that an interceptor arrangement as described in EP 1 075 415 would be difficult to use, since such an arrangement may require that the interceptor unit would have to be positioned such that its centre part will interfere with the components forming part of a waterjet unit.

SUMMARY OF THE INVENTION

Accordingly, the object of the present invention is to provide an arrangement for dynamic control of running trim and list of a boat or a vessel, which arrangement overcomes the above mentioned problems according to the appended claims, and which provides a stable and reliable unit which runs smoothly and which can be installed separately and after the actual manufacturing of a boat or vessel.

The above-mentioned object will be solved by means of an arrangement as defined in the appended claim 1.

According to a preferred embodiment, the invention relates to an arrangement for dynamic control of running trim and list of a boat, said boat having at least one hull with a stern, which arrangement has a housing member, an interceptor member, an actuating means, a power supply means and a guiding means.

According to an embodiment, said guiding means of the arrangement can be arranged to guide said interceptor member between a first end position and a second end position. Said guiding means has a first guiding member and a second guiding member, which are arranged to interact with each other and said first guiding member is a rotatable element arranged to extend transverse to the direction of displacement of said interceptor member, and said second guiding member is a guiding surface against which said first guiding member runs.

According to an embodiment, said actuating means can be arranged to displace said interceptor member, preferably in a continuous linear movement, between said first and second end positions in relation to said housing member. Furthermore, said actuating means is driven by said drive unit.

According to an embodiment, said housing member can be arranged so as to fully enclose said interceptor member in said first end position and so as to partially enclose said interceptor member in said end position.

According to an embodiment the first guiding member can be rotatably provided in a recess in said housing member and said second guiding member is provided on said interceptor member. Said first guiding member is an elongated rod provided with one or more fixedly attached spur gears which are provided on the ends of said elongated rod. According to an embodiment, said second guiding member is a gear rack.

According to an embodiment, said housing member and interceptor member can be elongated and said interceptor member extend substantially along the entire length of said housing member.

According to an embodiment, said elongated rod can extend substantially along the entire length of said housing member and said interceptor member. According to another embodiment of the invention, said elongated rod can be divided into several rods provided along the entire length of said housing member and interceptor member.

According to an embodiment of the invention, said actuating means is provided unsymmetrically at one end of said housing member and interceptor member.

Said actuating means comprises a drive unit with an electrical motor, which is arranged to provide a movement to said interceptor member in order to linearly displace said interceptor member towards said second end position and in a reverse direction to said first end position.

The arrangement according to the invention can be attached to a substantially vertical surface of said stern and extend along a limited portion of the horizontal width of said surface along a transom edge of said stern.

According to another embodiment, said first guiding member is rotatably provided in a recess in said interceptor member and said second guiding member is provided on said housing.

According to another embodiment, said actuating means is provided symmetrically between the ends of said elongated housing member and said elongated interceptor member.

In another alternative embodiment of the invention the first guiding member is provided in a cavity on a forward oriented surface of the rear section of the housing and the second guiding member is provided on a backward oriented surface of the interceptor blade.

BRIEF DESCRIPTION OF THE DRAWINGS

The invention will be described in detail to the attached figures. It is to be understood that the drawings are designed solely for the purpose of illustration and are not intended as a definition of the limits of the invention, for which reference should be made to the appended claims.

It should be further understood that the drawings are not necessarily drawn to scale and that, unless otherwise indicated, they are merely intended to schematically illustrate the structures and procedures described herein.

DETAILED DESCRIPTION

Figure 1:
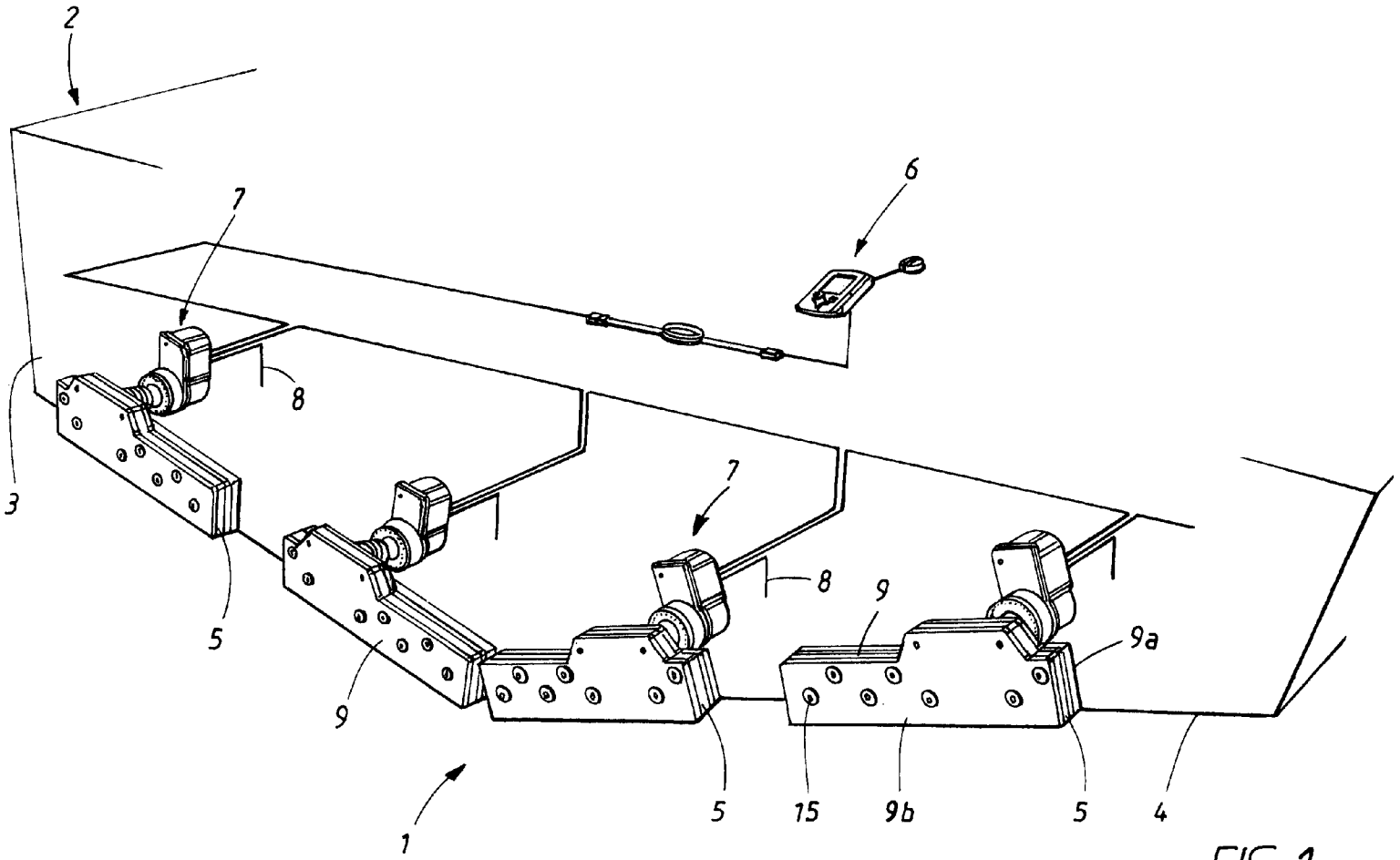
FIG. 1 shows a schematic isometric view of an arrangement according to a preferred embodiment of the invention provided on a stern of a boat.

In the description below, reference will be made to directions such as rear, front, up and down, if not otherwise stated. These directions are given with reference to the stem and stern of the boat at operation in a forward direction.

In the following, an arrangement according to the invention will be described with reference to FIG. 1-7. Furthermore, a preferred embodiment and alternative embodiments will be disclosed. The arrangement 1 according to the invention is intended for dynamic control of running trim and list of a boat or a vessel and dampening of boat motion. The arrangement 1 according to the invention is intended to generate an increase in pressure on a hull bottom directly ahead of a transom edge 4 by intercepting the flow with an interceptor blade 5 below the transom edge 4 to substantially raise the pressure over a large area. This results in a high hydrodynamic lift while the relatively small area of the projected interceptor blade 5 results in a low hydrodynamic drag.

In most applications, the interceptor blade 5 is arranged so as to extend (i.e. so as to be displaced in relation to a fully retracted position) up to approximately 50 mm. This would assume that the length of the interceptor blade 5 is of the magnitude 1000 mm. Consequently, the interceptor blade 5 is arranged for extending approximately 5% of its length. However, it should be noted that the invention is not limited to such dimensions only. Generally, the interceptor blade 5 may be for example of a length which is between approximately 500 mm and 2000 mm. In the case of an interceptor blade which is approximately 500 mm, it may extend approximately 9-10% of its length. In the case of an interceptor blade which is approximately 2000 mm, it may extend approximately 2-3% of its length. Variations from such dimensions may occur and generally it can be said that the interceptor preferably is arranged so that it may extend a distance which is of the magnitude 2-10% of the interceptor length.

FIG. 1 shows a schematic isometric view of several interceptor assemblies 1 according to a preferred embodiment of the invention arranged to the hull 2 on a stern 3 of the boat or the vessel. The arrangement 1 is attached to a substantially vertical surface of the stern 3 and extends along a limited portion of the horizontal width of the vertical surface along the transom edge 4 of the stern 3.

Even though FIG. 1 shows four different arrangements 1 according to the embodiment, it should be noted that the invention is not limited to such a number only. In other words, the invention can be implemented with one, two or more arrangements 1 depending on the actual need in each application.

The arrangement 1 according to the invention is connected to a control unit 6 with a control panel provided on a bridge of the boat. The operator of the boat can manoeuvre the trim and list of the boat via the control panel. This is done simultaneously as the driver regulates the speed and the course of the boat, which is done via a throttle control and a steering wheel (not shown), respectively.

Each arrangement 1 according to FIG. 1 comprises a drive unit 7, which is connected to and regulated by the control unit 6. The drive unit 7 (or servo unit) is further connected to a power supply means 8 and a housing 9 of the arrangement 1. The housing 9 is only shown partially in FIG. 2. More precisely, only a front part of the housing 9 is shown, whereras a rear part is not shown. However, it should be made clear that the interceptor blade 5 is arranged between such a front part 9*a* and a rear part 9*b*. FIG. 1 also shows that the interceptor blade 5 is arranged between a front part and a rear part of a housing 9. Also, the power supply means 8 is constituted by an electrical power supply of a conventional type for marine applications.

The interceptor blade 5 and the housing 9 are suitably made of a material which is persistent to marine influence. Such materials might be fibre reinforced polymer resin, non-reinforced or reinforced plastic or composite materials, metals e.g. stainless steel or aluminium, rubber or other suitable materials.

Figure 2:
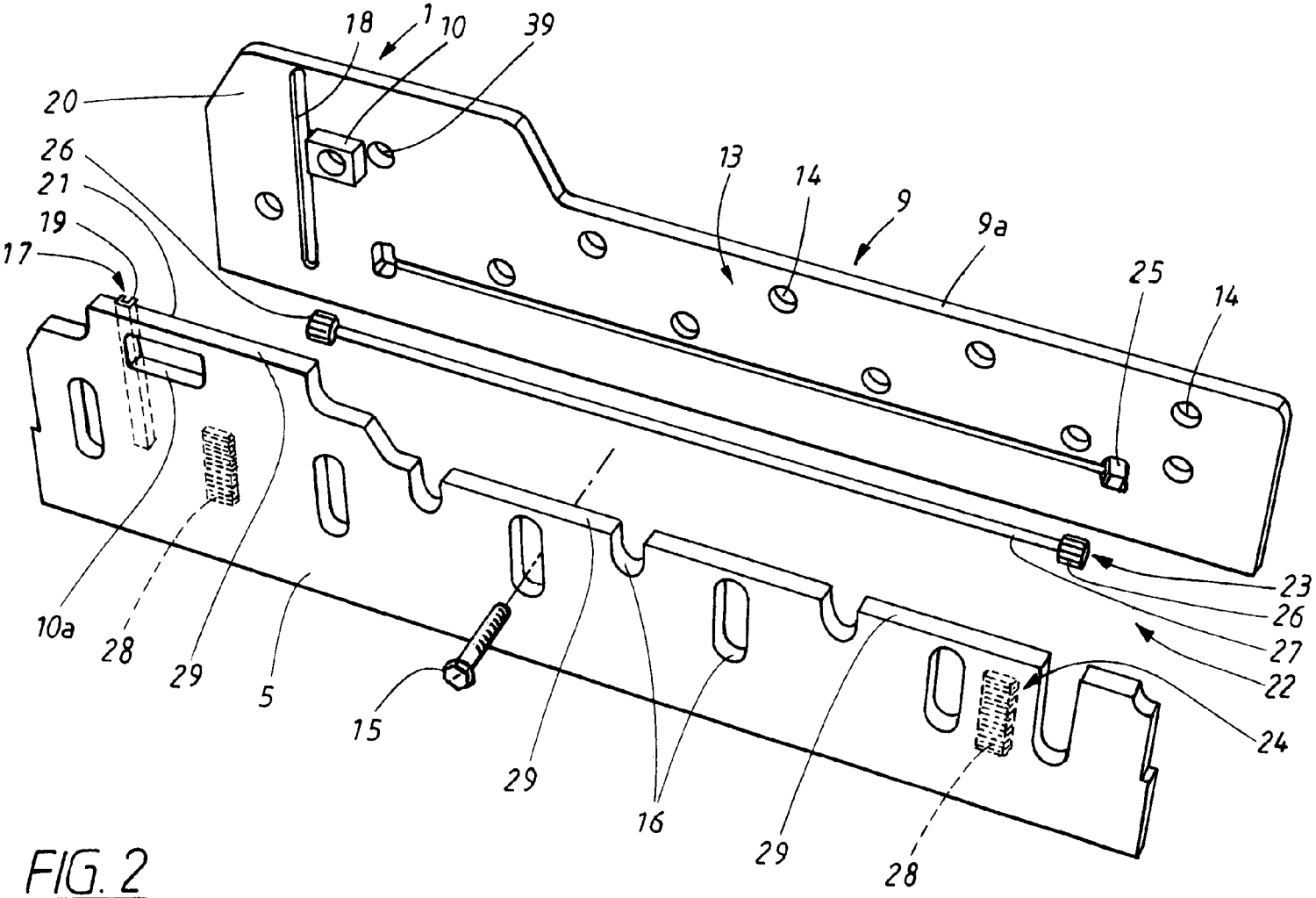
FIG. 2 shows an exploded view of the arrangement according to FIG. 1.

As shown in FIG. 2, the arrangement 1 according to the invention further comprises an actuating means 10. The actuating means 10 is arranged for displacing the interceptor blade 5, preferably in a continuous linear movement, between a first end position and a second end position or vice versa in relation to the housing 9. This linear movement is generally in the vertical direction, provided that the surface of the stern 3 is oriented along a generally vertical plane. In other words, the movement of the interceptor blade 5 is suitably along the same direction as the plane along which the stern 3 is arranged.

The arrangement according to the invention is fixedly attached to the hull 2 of the boat with attachment means (not shown). The attachment means are preferably constituted of a number of through-holes in the housing 9 and fixing means, for example screws, which are attached to the hull 2 of the boat.

FIG. 2 shows an exploded view of the arrangement 1 with the housing 9, viewed from rear. The housing 9 is elongated and comprises a front section 9*a* and a rear section 9*b* (not shown in FIG. 2). The front section 9*a* is arranged closest to the stern 3. The front rear sections are is attached to each other by attachment means 13 which preferable are holes 14 and some kind of attachment devices 15 such as e.g. screws. The front section 9*a* is provided with the attachment holes 14 and the rear section carries the attachment devices 15, or vice versa. The attachment means 13 are preferably arranged in a zig-zag pattern to create an evenly distributed clamping force along the elongated housing member 9 against the stern 3 surface.

Between the front section 9*a* and the rear section 9*b* of the housing 9, the interceptor blade 5 is arranged. The interceptor blade 5 is displaceable inside the housing 9 so as to move between a first end position and a second end position, and vice versa. In the first end position the interceptor blade 5 is fully contained inside the housing 9, and in the second end position the interceptor blade 5 is partially contained inside the housing 9. The interceptor blade 5 is provided with a number of through holes 16, through which the attachment means 13 of the housing 9 extend. Some of the through holes 16 are elongated and some of the through holes 16 are shaped like U-shaped recesses provided along an upper edge 29 of the interceptor blade 5. These through holes 16 allow the interceptor blade 5 to be displaced between the first and second end positions even if the interceptor blade 5 is arranged between the front and rear sections of the housing 9 and perforated by the attachment devices 15. As mentioned above, the displacement of the interceptor blade 5 is suitably along a generally vertical direction.

Further, the interceptor blade 5 is provided with one or more transverse guiding means 17 which are arranged to guide the interceptor blade 5 in a linear movement.

The transverse guiding means 17 are preferably arranged on one side of the actuating means 10. Also, the transverse guiding means 17 extend in the direction of displacement of the interceptor blade 5. The transverse guiding means 17 are preferably constituted by a straight recess 18 provided on a backwards oriented surface 20 of the front section 9*a*. The recess 18 cooperates with a projecting strip 19 arranged on a inner and forward oriented surface 21 of the interceptor blade 5.

Further, the arrangement 1 is provided with guiding means 22 to guide the interceptor blade 5 at application of a displacement force. The guiding means 22 help to prevent jamming of the elongated interceptor blade 5.

The guiding means 22 comprises a first guiding member 23 and a second guiding member 24, which are arranged to interact with each other. The first guiding member 23 is a rotatable element arranged to extend transverse to the direction of displacement of the interceptor blade 5, and the second guiding member 24 is a guiding surface against which said first guiding member 23 runs.

Further, the first guiding member 23 is fixedly and rotatably arranged in cavity 25 in the backwards oriented surface of the front section. The cavity 25 is preferably H-shaped. The second guiding member 24 is arranged on the forward oriented surface 21 of the interceptor blade 5. According to the embodiment, the first guiding member 23 is an elongated rod 27 which is provided with one or more fixedly attached spur gears 26. The spur gears 26 are preferably arranged on the ends of the rod 27. The spur gears 26 mesh with the second guiding member 24, which according to the embodiment is constituted by one or more gear racks 28.

In one end section of the elongated housing 9, the actuating means 10 is arranged to act on the interceptor blade 5. The actuating means 10 is preferably transversely arranged to the extension length of the interceptor blade 5 and arranged on the front section 9*a*. The actuating means 10 is arranged to act on an upper edge 29 of the interceptor blade 5 to displace the interceptor blade 5 in its continuous linear movement between the first and second end positions, as described above.

In the shown embodiment, the actuating means 10 is connected to the drive unit 7 (not shown in FIG. 2) which has an electrical motor connected to the power supply means 8. The electrical motor is arranged to provide a movement of the interceptor blade 5 (by acting on the actuating means 10) in order to transfer the rotational movement of the electrical motor to a linear movement of the interceptor blade 5. To this end, electrical motor comprises a rotating shaft (not shown) arranged to protrude through an opening 39 in the housing 9 acting as a shaft guiding means and being connected to the actuating means 10. Also, the actuating means 10 is arranged to cooperate with an opening 10*a* or recess in the interceptor blade 5.

Figure 3:
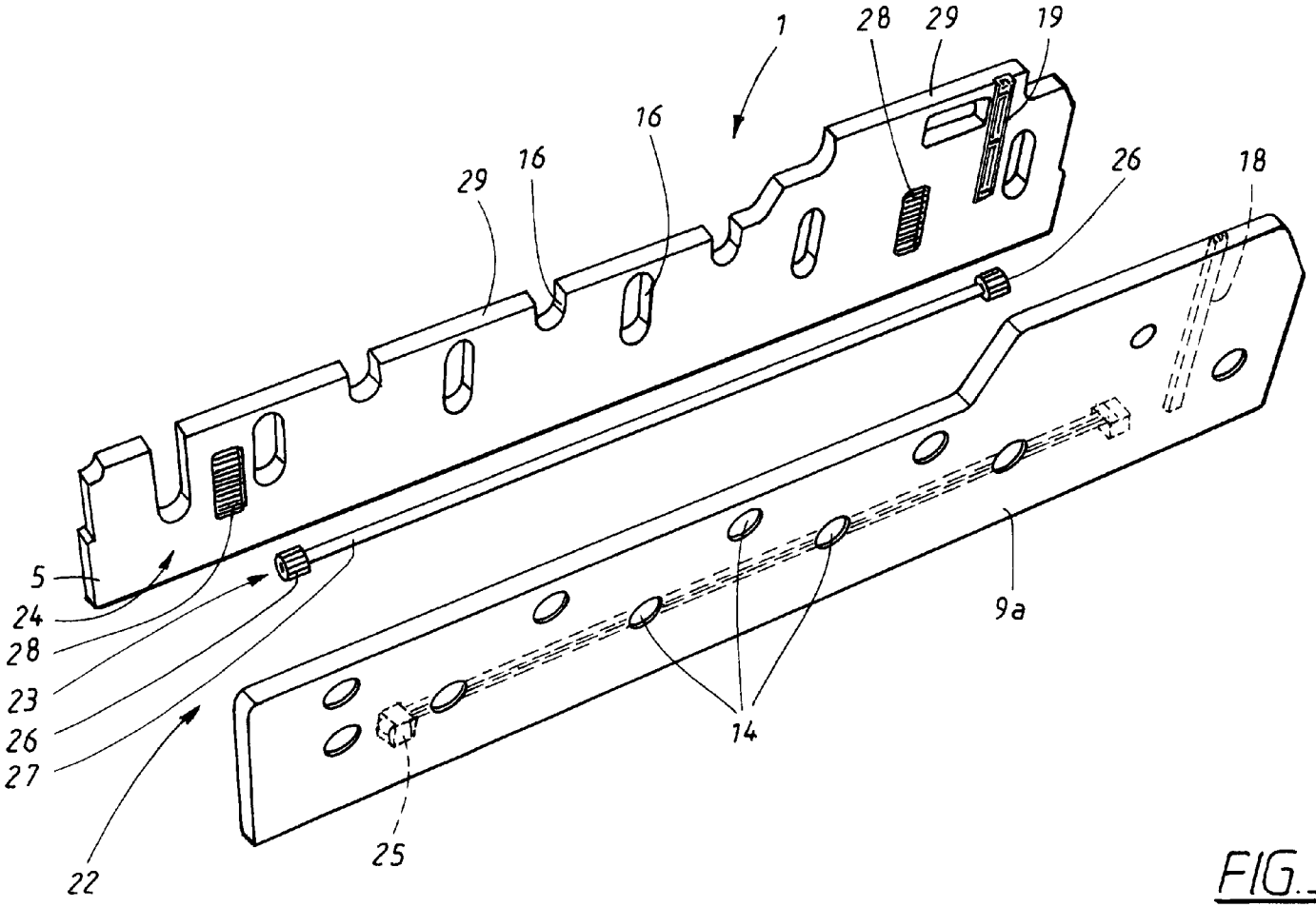
FIG. 3 shows an exploded view of the arrangement according to FIG. 1 as regarded from another angle than FIG. 2.

FIG. 3 shows an exploded view of the arrangement 1 according to FIG. 2, as viewed from a front view.

Figure 4:
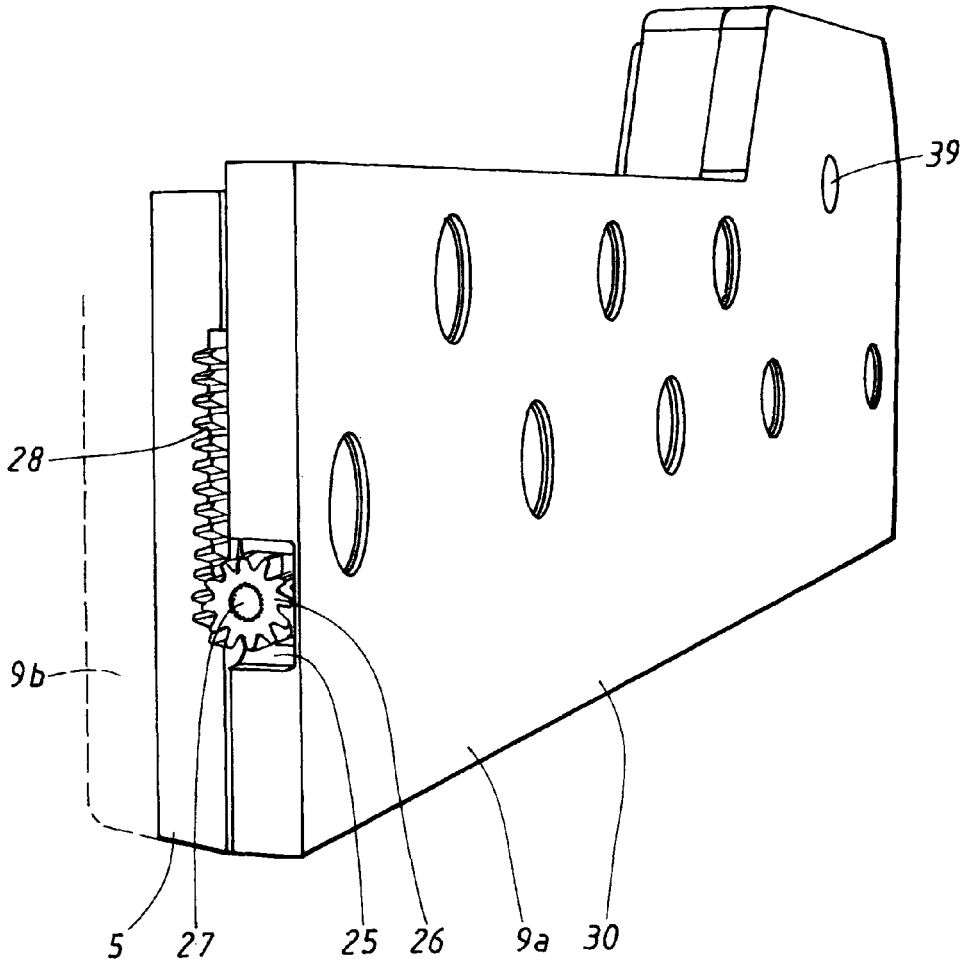
FIG. 4 shows a cross sectional view of the arrangement according to FIG. 2, in a first end position.

FIG. 4 shows a cross sectional view of the arrangement 1 in the first end position. The housing 9 is shown with the front section 9*a*. However, as indicated in FIG. 1, it should be clear that the interceptor blade 5 is provided between a front section 9*a* and a rear section 9*b*. The front section 9*a* is provided with the H-shaped cavity 25 in which the elongated rod 27 with the spur gears 26 is rotatably arranged. The interceptor blade 5 is provided with gear teeth provided in a row, in the form of a gear rack 28. Further, a shaft guiding means 39 in which the drive unit 7 (not shown in FIG. 4) is connected, is provided on a forward oriented surface 30 of the front section 9*a*.

Figure 5:
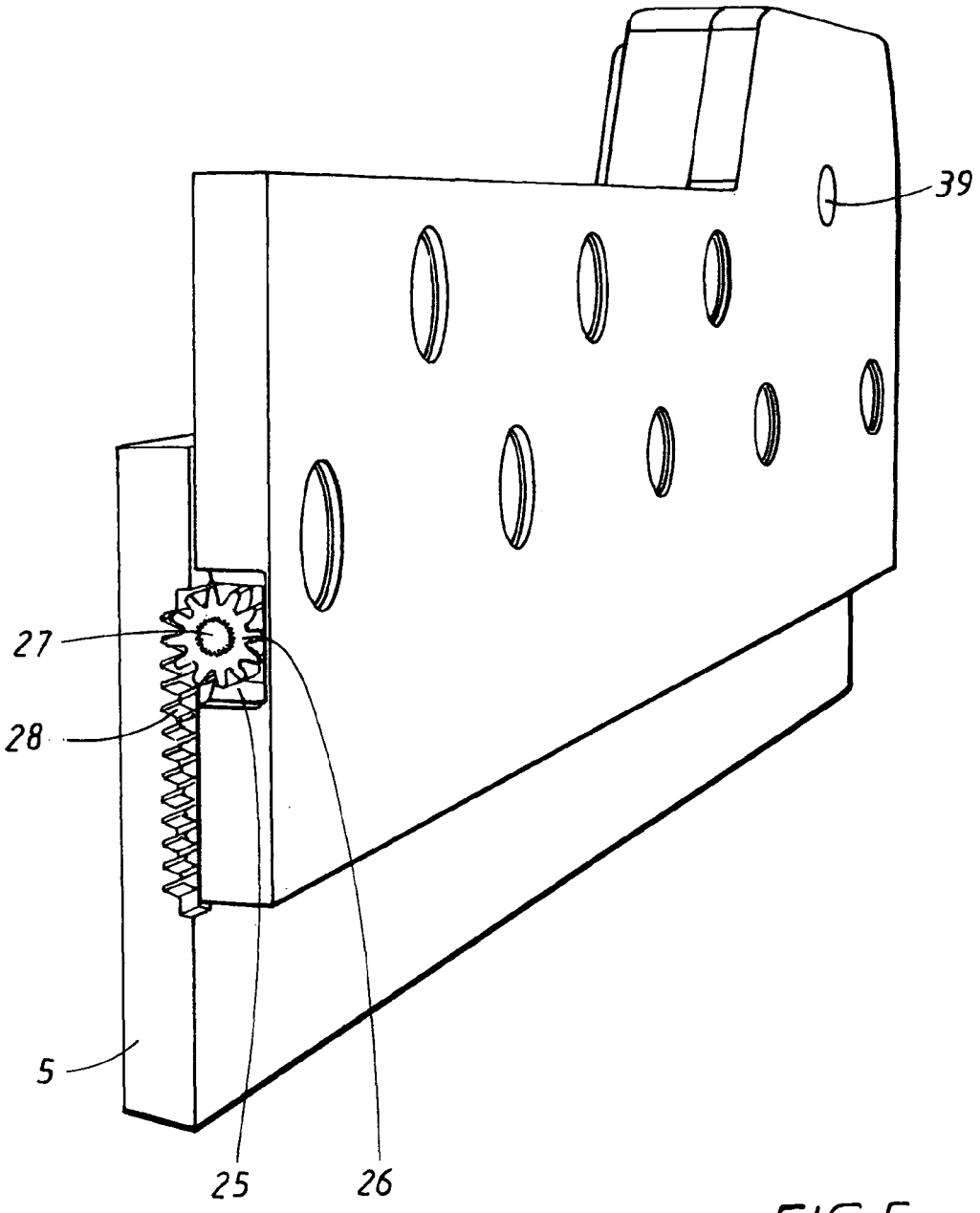
FIG. 5 shows a cross sectional view of the arrangement according to FIG. 2, in a second end position.

FIG. 5 shows a cross sectional view of the arrangement 1 in accordance with FIG. 4. However, in FIG. 5, the interceptor blade 5 is displaced to the second end position by the actuating means 10 (not visible in FIG. 5) which in turn is driven by the drive unit. The length of the displacement of the interceptor blade 5 depends on the length of the gear rack 28.

Figure 6:
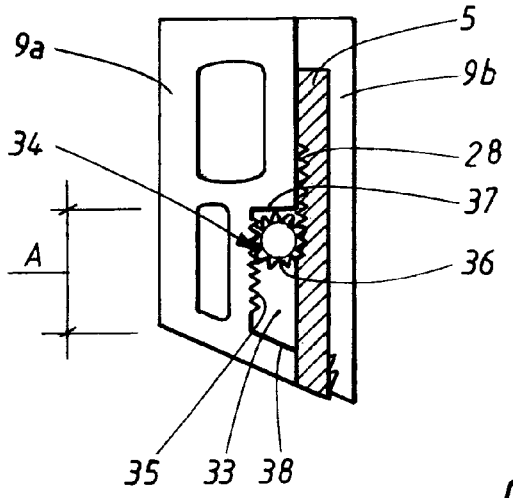
FIG. 6 shows a cross sectional view of an arrangement according to a further embodiment of the invention.

FIG. 6 shows a cross sectional view of the arrangement 1 in the first position according to another alternative embodiment of the invention. Only the features according to this alternative embodiment that distinguish from the preferred embodiment described above will be described below. A cavity 33 in the front section 9*a* has a height A which preferably corresponds to the length of one or more of the gear racks 28 provided on the interceptor blade 5. The width of the cavity 33 is uniform along its entire length. A front wall 34 of the cavity 33 is provided with gear teeth 35, which interact with one or more spur gears 36, provided on the rod 27, at the same time as the spur gears 36 interact with the gear racks 28, during the movement between the first and second end positions and vice versa. The gear teeth 35 of the cavity 33 can extend along the entire length of the cavity 33 or at those positions where spur gears 36 are provided. The rod with the spur gears 36 is rotatably arranged in the cavity 33, and the rod can be transferred from an upper surface 37 of the cavity 33 to a lower surface 38 of the cavity 33, by rotation, when the actuating means 10 displaces the interceptor blade 5 between the first and second end positions.

Figure 7:
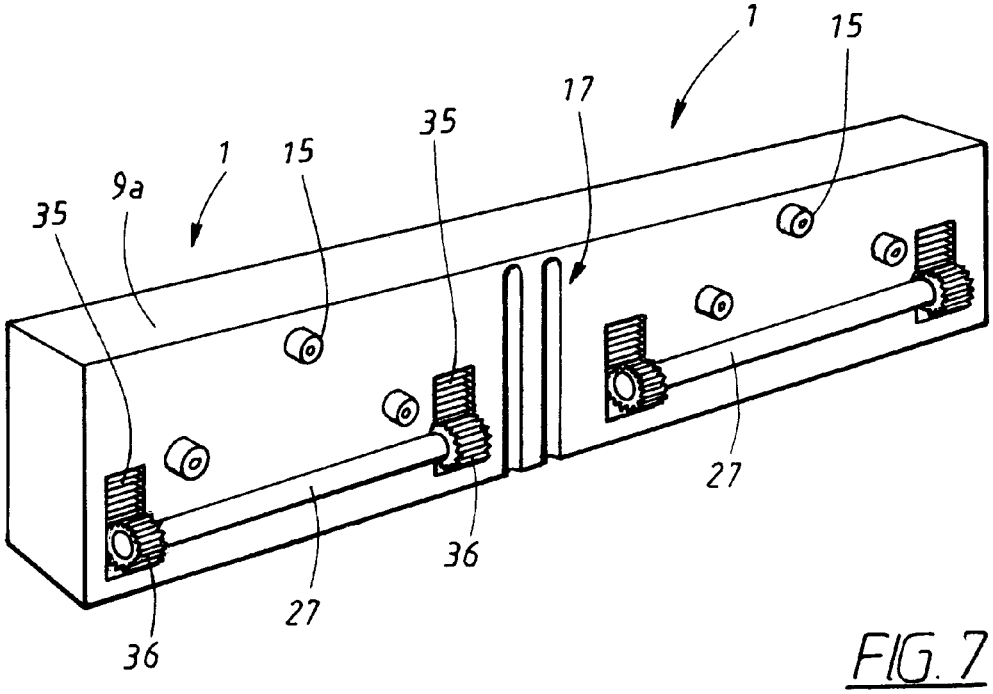
FIG. 7 shows a schematically isometric view of another embodiment of the invention comprising two arrangements according to the invention.

FIG. 7 shows a schematically isometric view of another embodiment of the invention comprising two arrangements 1 according to the embodiment of the invention shown in FIG. 6. Thus, it is also possible to use two arrangements 1 according to other embodiments of the invention, e.g. as shown in FIG. 6.

In FIG. 7, the actuating means (not shown) is provided symmetrically between the ends of the front section 9*a* to be able to act in the middle of the interceptor blade 5 (not shown in FIG. 8), preferably above the transverse guiding means 17. The two arrangements 1 are also arranged symmetrically between of the ends of the elongated housing 9.

Further, FIG. 7 shows the front section 9*a* of the housing 9, which front section 9*a* is equipped with the attachment devices 15 of the attachment means 13. The arrangement comprises gear racks 35 provided on the front section 9*a*. The gear racks 35 mesh with the spur gears 36 provided on the rod 27.

The invention is not limited to the embodiments described above, but can be varied within the scope of the appended claims. For example, the first guiding member 23, i.e. the elongated rod 23 shown for example in FIG. 2, can be provided with gears in the form of spur gears, as described above, or alternativetly with helical gears on either end, or on both ends.

The invention claimed is:

1. An arrangement configured for guiding and preventing jamming of an interceptor member for a dynamic control of running trim and list of a boat, said boat comprising at least one hull having a stern, said arrangement comprising:

an elongated housing member mounted on the stern of the boat, said housing member having front and rear walls and extending transversely along the stern, said housing member configured for fully enclosing an interceptor member in a first end position and partially enclosing said interceptor member in a second end position; and a guiding means fixedly and rotatably arranged in a cavity formed in one of the front and rear walls of the housing member, the guiding means configured to guide the interceptor member between the first end position and the second end position, the guiding means comprising:

an elongated rotatable rod disposed substantially horizontally within the cavity and arranged to displace the interceptor member in a substantially vertical direction between the first and second end positions, the rotatable rod comprising:

a first end and an opposing second end;

a first spur gear on the first end that is configured to mesh with a first gear rack on a first side of the interceptor member, and a second spur gear on the second end that is configured to mesh with a second gear rack on a second side of the interceptor member, said housing member mounted on the stern so that when the interceptor member is in the second end position, water pressure acting on a bottom of the hull in front of the interceptor member is higher relative to a water pressure when the interceptor member is in the first end position.

2. The arrangement of claim 1, wherein the cavity is substantially H-shaped.

3. The arrangement of claim 1, wherein when in the second end position, the interceptor member is lower than when it is in the first end position.

4. The arrangement of claim 1, further comprising a transverse guide configured to prevent movement of the interceptor member with respect to the housing member in the transverse direction.

* * * * *